US006577294B1

(12) United States Patent
Nishida

(10) Patent No.: US 6,577,294 B1
(45) Date of Patent: Jun. 10, 2003

(54) DISPLAY DEVICE

(75) Inventor: Shinsuke Nishida, Tokyo (JP)

(73) Assignee: Fourie, Inc., Tokyo (JP)

( * ) Notice: Subject to any disclaimer, the term of this patent is extended or adjusted under 35 U.S.C. 154(b) by 0 days.

(21) Appl. No.: 09/144,979

(22) Filed: Sep. 1, 1998

(30) Foreign Application Priority Data

Sep. 30, 1997 (JP) ..... 9-282852

(51) Int. Cl.[7] ..... G09G 3/36

(52) U.S. Cl. ..... 345/90; 345/55; 345/92; 345/214

(58) Field of Search ..... 345/121, 126, 345/127, 129, 130, 509, 515, 193, 55, 214, 87, 90, 92

(56) References Cited

U.S. PATENT DOCUMENTS 4,385,352 A * 5/1983 Bienvenu ..... 364/200
4,712,140 A * 12/1987 Mintzer et al. ..... 358/260
4,920,504 A * 4/1990 Sawada et al. ..... 364/521
4,947,344 A * 8/1990 Hayashi et al. ..... 364/518
5,250,934 A * 10/1993 Denber et al. ..... 345/136
5,282,275 A * 1/1994 Andre et al. ..... 395/400
5,325,486 A * 6/1994 Omori et al. ..... 395/511
5,341,466 A * 8/1994 Perlin et al. ..... 345/439
5,430,464 A * 7/1995 Lumelsky ..... 345/191
5,864,347 A * 1/1999 Inoue ..... 345/516
6,006,314 A * 12/1999 Suzuki ..... 711/217
6,061,473 A * 5/2000 Chen et al. ..... 382/235
6,115,017 A * 9/2000 Mikami et al. ..... 345/92

FOREIGN PATENT DOCUMENTS

JP 9144296 6/1997

* cited by examiner

*Primary Examiner*—Steven Saras
*Assistant Examiner*—Alecia D. Nelson
(74) *Attorney, Agent, or Firm*—Sughrue Mion, PLLC

(57) ABSTRACT

A display device, in which, when a relative address of an area b is "01", and if a relative address of an area c in a screen is changed to "01", an image displayed on the area b shifts to the area c; when a relative address is changed to "01", a controller for a display element constituting the area c selects a display signal having the relative address "01" among display signals passing through a signal transferring section, and picks the signal up.

13 Claims, 7 Drawing Sheets

| DISPLAY RESOLUTION INFORMATION | ADDRESS INFORMATION | DISPLAY DATA INFORMATION |
|---|---|---|

| DISPLAY RESOLUTION INFORMATION | ADDRESS INFORMATION | DISPLAY DATA INFORMATION |
|---|---|---|
| FOUR-DIVIDED | ADDRESS 「01」 | 1=ON |

DISPLAY DEVICE

FIELD OF THE INVENTION

The present invention relates to a display device and more particularly, to a display device that can easily move, enlarge, or reduce a screen.

BACKGROUND OF THE INVENTION

In recent years, the electronic display has played an extremely important role in the computerized society, and has widely been used for various applications both in industrial and consumer fields. The electronic display converts an electric signal outputted from various kinds of electronic equipment to an optical information signal which can visually be recognized by human. As the electronic display, there have been known displays a cathode-ray tube display (CRT), a plasma display (PDP), and an electroluminescent display (ELD) each referred to as a light-emitting type one, and a liquid crystal display (LCD) or an electrochemical display (ECD) referred to as a light-receiving type one.

Also in recent years, in association with rapid development in the fields of IC and LSI, various types of small-sized, light-weight and power-saving display unit have been developed, and at the same time, social needs for display units which are thin and light-weight can be driven with a low voltage at a low power-consumption rate have been increasing. Further, it has been strongly desired to develop a display unit which can respond to rapid increase in an amount of information to be processed. Especially, with progress in the multimedia technology, the electronic display has increased its importance as an indispensable item for accessing a cyber space, and a larger size of screen with higher resolution are desired further more strongly.

However, an image transfer system in the conventional type of electronic display units as described above is based on the scanning line system in which image data is continuously transmitted with preset resolution as well as with a preset number of scanning lines, and this conventional type of display unit can not basically support a case when a size of a screen is arbitrarily changed and the resolution (the number of display elements in the horizontal direction) as well as the number of scanning lines (the number of display elements in the vertical direction) are changed, and for this reason, it has been impossible for manufacturers to materialize the idea itself that the size of a screen is arbitrarily changeable by a user.

For example, even when the size of a screen is made larger and resolution (the number of display elements in the horizontal direction) as well as the number of scanning lines (the number of display elements in the vertical direction) are increased, the resolution and the number of scanning lines of image data to be sent in the scanning line system remain the same, so that it is impossible to display an image by using the entire screen. Also, when it is tried to forcefully display the image, the image is displayed only on a part of the screen in response to the resolution as well as to the number of scanning lines of the transferred image data. In other words, even when the size of a screen is made larger, resolution of an image to be displayed on the screen can not be made higher.

SUMMARY OF THE INVENTION

As an invention for solving the problems as described above, there is the one already applied by the present applicant (Japanese Patent Laid-Open Publication No. HEI 9-144296). For more details, the application should be referred to. It is an object of the present invention to provide an effective screen display system based on the concepts as recited in the above patent application.

The display device according to the present invention comprises a display unit for arranging display elements and constructing a screen by adding an absolute address to each of the display elements; and an address control unit for converting the absolute address to a relative address capable of specifying a screen on the display unit and changing the relative address, so that, when a screen is to be specified according to a relative address, it is possible to change a screen to be specified by changing this relative address. Through the steps described above, it is possible to easily change a position of a screen as well as a screen size without any change in the display data to be supplied only by changing the relative address.

In the display device according to the present invention, an image is displayed by dividing a screen according to a specified format, repeating the division thereof one after another by further dividing each of the divided unit areas, specifying each of the divided unit areas with bits, and supplying display data to each divided unit area, so that it is possible to change a position or a size of the divided unit area by way of operating bits. Namely, as a divided unit area can be specified with bits, when these bits are operated, also the specified divided unit area can be changed. And for this reason, it is possible to easily change a position or a size of a screen by way of operating bits.

In the display device according to the present invention, an image is displayed on a screen by arranging display elements at a matrix to form a screen, repeatedly dividing the screen, allocating an address to each divided unit area each time division is executed, specifying each of the divided unit areas according to each of the addresses, and supplying display data to the specified divided unit area. Then the image can be moved, enlarged, or reduced by changing the address. With the configuration as described above, it is possible to easily move a screen without any change in the display data only by way of changing the address.

Other objects and features of this invention will become understood from the following description with reference to the accompanying drawings.

DESCRIPTION OF THE PREFERRED EMBODIMENTS

Next detailed description is made for preferred embodiments of the present invention with reference to the related drawings. It should be noted that the present invention is not limited by these embodiments. The present invention moves and reduces or enlarges a display on a screen, and at first, description is made for contents of the display system based on the present invention.

Figure 1:
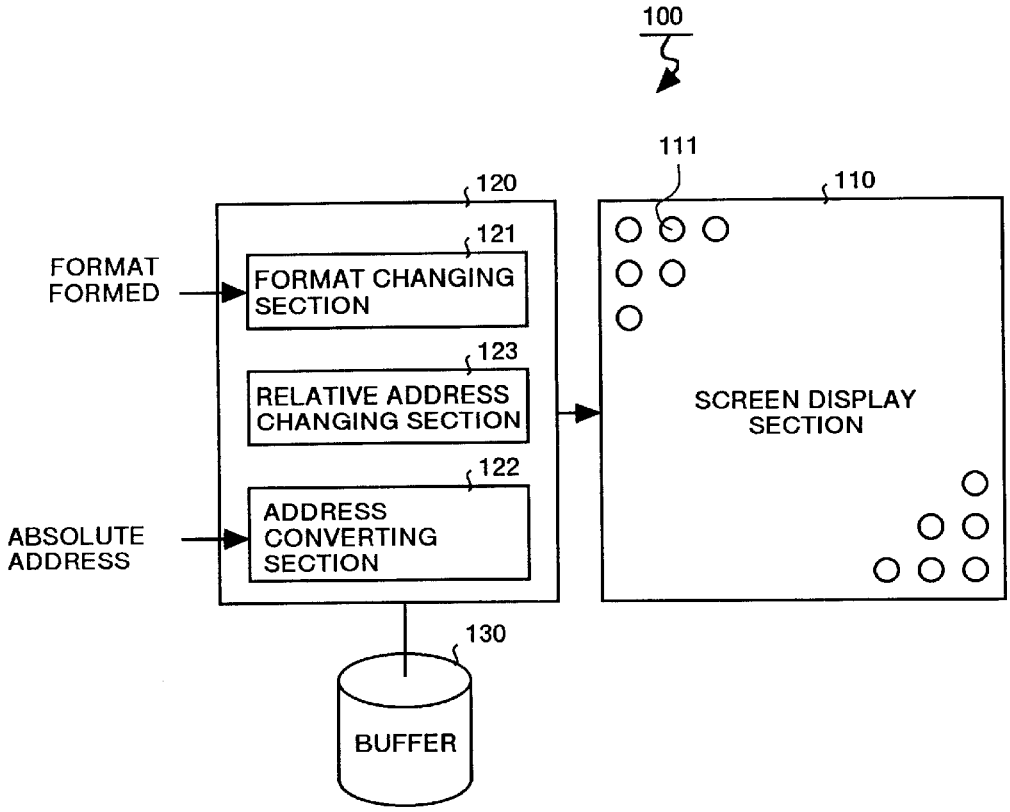
FIG. 1 is a block diagram schematically showing a display device according to the present invention.
Figure 2:
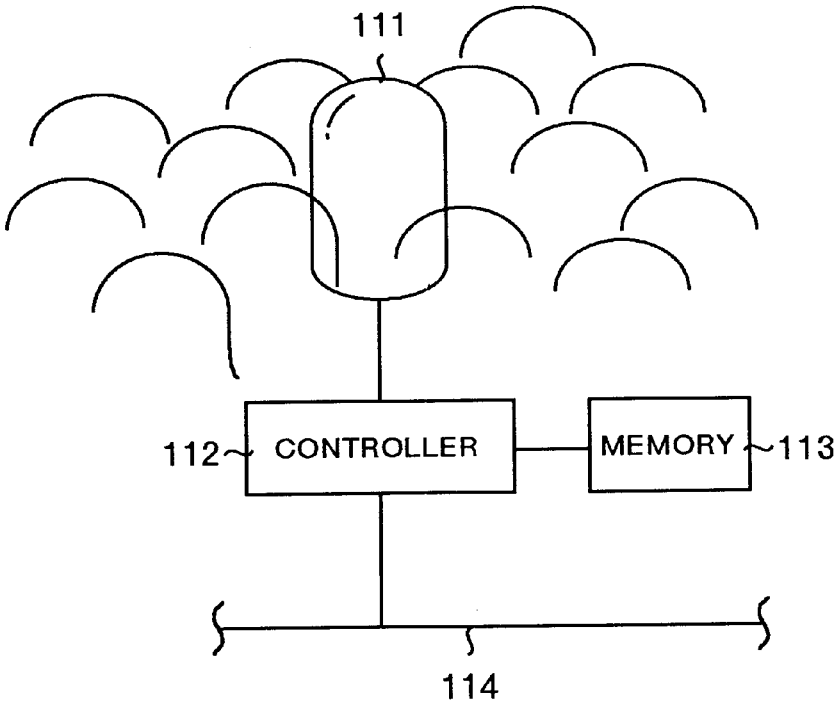
FIG. 2 is a view schematically showing a construction of display elements shown in FIG. 1.

FIG. 1 is a schematic block diagram showing a display device according to the embodiment of the present invention. This display unit 100 comprises a screen display section 110 formed with display elements 111 arranged in a matrix form, and a control section 120 for controlling this screen display section 110. The control section 120 has a format changing section 121, an address converting section 122, and a relative address changing section 123. FIG. 2 is a block diagram schematically showing a construction of the display elements 111. Each of the display elements 111 has a controller 112 for controlling a display state of the display element 111 and a memory (storing section) 113 for storing therein address information for the display element 111 respectively. The reference numeral 114 indicates a signal transferring section for executing signal transaction between the controller 112 and the control section 120. The reference numeral 130 indicates a buffer for temporarily storing therein a display signal. Located inside the display element 111 are three light-emitting diodes R, G, and B, so that color display can be performed with the three colors of R (Red), G (Green), and B (Blue). It should be noted that power is supplied from a home power supply unit.

Allocated to each of the display elements 111 is a specific address (absolute address) respectively at the time of production thereof, and the absolute address is stored in the memory 113. The controller 112 selects and fetches a signal corresponding to the absolute address of the display element 111 from display signals sent from the signal transferring section 114. Each of the absolute addresses is set specifically to each of the display elements, and for this reason, if addresses are allocated to display signals and transferred, the display elements actuate randomly, which makes it impossible to display a normal image. For this reason, it is required to convert an absolute address of a display element 111 to a relative address for enabling formation of an image according to a specified format. The address converting section 122 converts an absolute address to a relative address.

A format is, as shown in FIG. 3A to FIG. 3D, based on a system in which a screen on the display section 110 is divided into quarters and repeating his quartering operations successively. Although the screen can physically be divided into size of a unit of display element 111, the screen can further be divided artificially by controlling a display state of the display element 111 (for instance, by way of suppressing the light-emitting rate to 70%). It should be noted that, although a case of repeating division of the screen into quarters is assumed in FIGS. 3A to 3D, the format is not limited to this one. For example, a format at which a screen is divided only in the vertical direction may be employed.

Figure 3A:
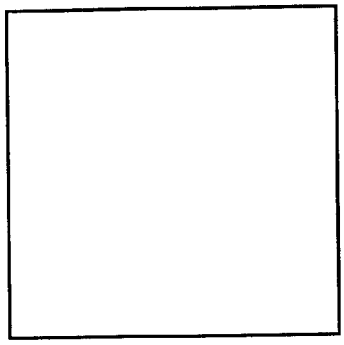
FIGS. 3A to 3D are explanatory views showing examples of a format.
Figure 3B:
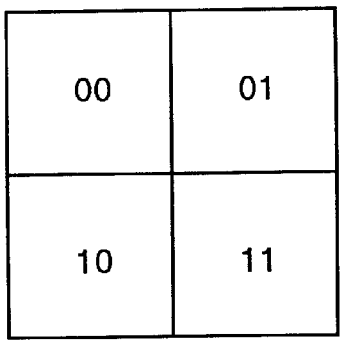
Figure 3C:
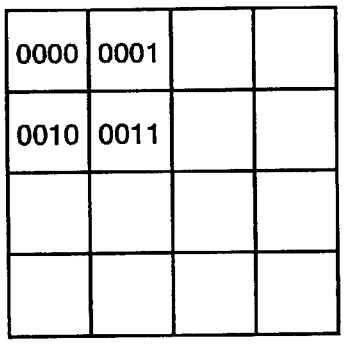
Figure 3D:
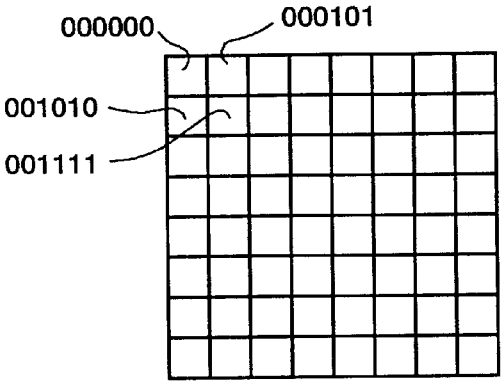

An absolute address allocated to each of the display elements 111 is converted to a relative address according to the format. An address conversion table for storing therein a correlation between absolute addresses and relative addresses is provided for the conversion. Next description is made for a relative address to which an absolute address is converted. As shown in FIG. 3B to FIG. 3D, relative addresses each consisting of 2 bits: "00", "01", "10", and "11" are set to the divided unit areas respectively for each conversion of the screen into quarters. When one of the divided unit areas is further divided into quarters, a 2-bit relative address expressed as any of "00", "01", "10", and "11" is added to each of the of the relative address respectively. For example, divided unit areas obtained by dividing a divided unit area having a relative address "00" into quarters are expressed with formats obtained by adding 2 bits of "00" to "11" to the end of the relative address "00", namely, the formats are "0000", "0001", "0010", and "0011". A relative address is set each time a screen is divided as described above. It should be noted that, when setting a relative address, it is not necessarily required to use the 2-bit address format as described above so long as each divided unit area can be identified.

Figures 4, 5:
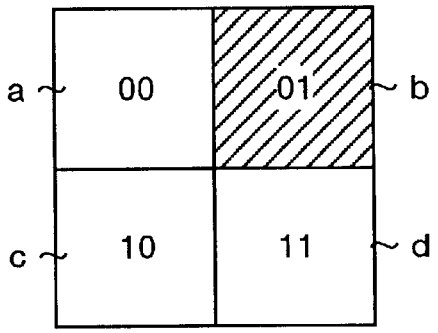
FIG. 4 is an explanatory view showing a structure of a display signal to be supplied to the screen display section shown in FIG. 1.
FIG. 5 is an explanatory view showing an example of display according to the display signal.

FIG. 4 is an explanatory view showing a structure of a display signal to be supplied to the screen display section 110. A display signal comprises information for display resolution, information for relative address, and information for display data. The information for display resolution is information indicating the number of divisions of a screen. The information for relative addresses is information for specifying a divided unit area and is expressed with 2 bits as described above. The information for display data is information indicating display contents in the divided unit area specified by the information for relative address. For example, as shown in FIG. 5, the display resolution information "0001" indicates each screen divided into quarters. (areas a to d). Also, the relative address information "01" indicates that a divided unit area b is specified. The display data information "1" indicates that the specified area b is turned "ON".

Next description is made for movement of an image and enlargement or reduction of the size thereof according to the present invention.

Figure 6:
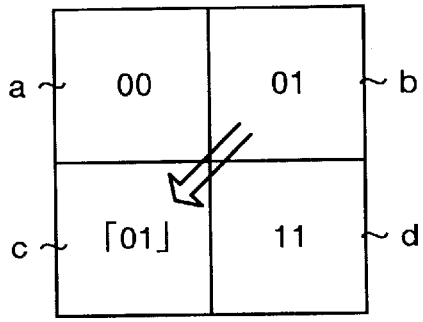
FIG. 6 is an explanatory view showing a case when a screen is moved by way of changing an address.

A screen can be moved by way of changing a relative address. A relative address is changed by the address changing section 123. When the relative address of an area c in the screen is changed to "01" as shown in FIG. 6, an image displayed on the area b is moved to the area c. When the relative address is changed to "01", the controller 112 for the display element 111 constituting the area c selects a display signal having the relative address "01" among display signals passing through the signal transferring section 114. If the relative address of the area b remains "01", the same image appears on the area c as well as on the area b. It should be noted that a relative address to be changed might be temporary or continuous.

When the screen currently displayed on the area b is to be moved, a display signal stored on the memory 113 for the display element 111 constituting the area b is sent to the display element 111 and to the signal transferring section 114. A display signal stored in the buffer 130 may be sent thereto. In this case, the processing in the control section 120 is also executed. A display signal is sent according to an instruction indicating sending of a signal issued from the control section 120. Then, when the relative address of the area c in the screen is changed to "01", the controller 112 for the display element 111 constituting the area c selects a display signal having the relative address "01". As described above, by changing a relative address, a screen can be moved without adding any change to the display signal. Further by sending different addresses with a plurality of display signals added thereto, a screen can be moved while different images are being displayed on a plurality of screens. It should be noted that conversion of an address by the address converting section 122 is not substantially different from changing of the address by the address changing section 123, so that a screen can be moved according to the same sequence as described above also when this method is employed.

Figure 7:
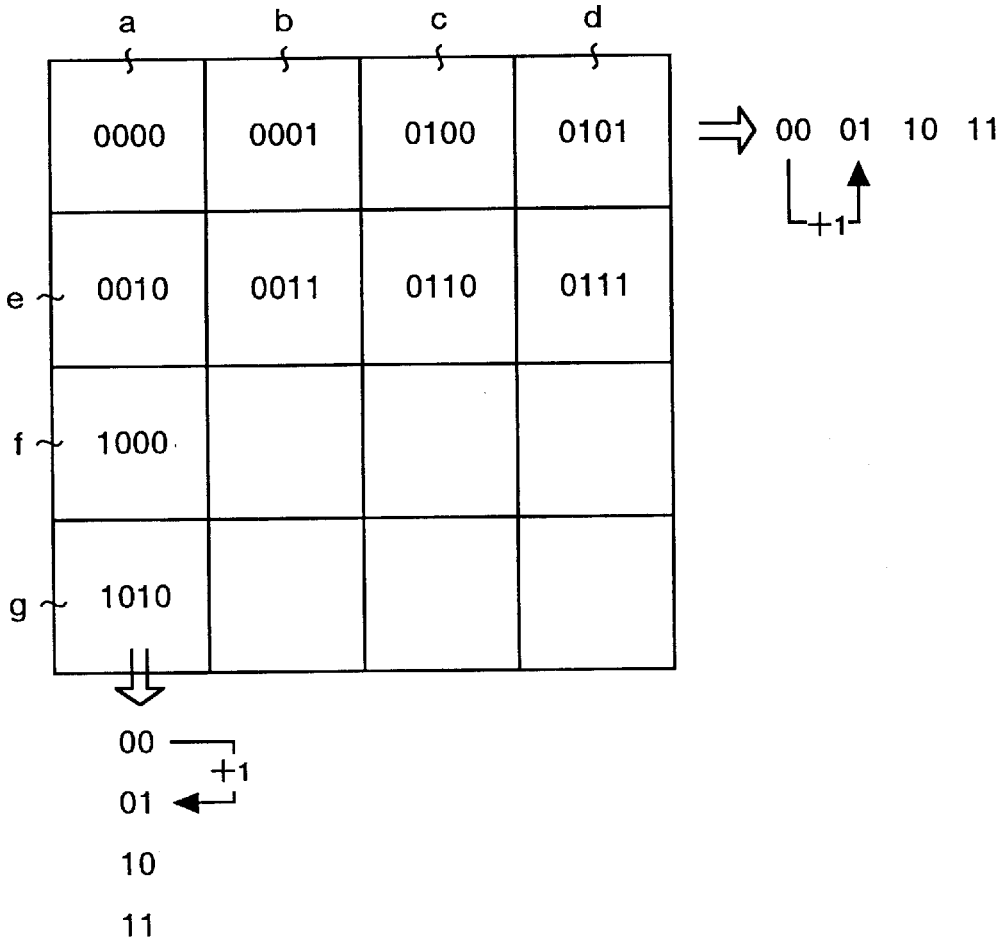
FIG. 7 is an explanatory view showing a case when a screen is moved by way of operating bit.

FIG. 7 is an explanatory view showing a case when a screen is moved by way of operating bits. Description assumes a case as an example where a screen is divided into 16 divided unit areas for convenience of description. Referring to the first row from the top, and when even digits (second digit and fourth digit) are extracted from the relative addresses "0000", "0001", "0100" and "0101", binary expressions "00", "01", "10" and "11" are obtained. Accordingly, the screen shifts to the right side each time an even digit is incremented by one with a binary number. For example, when the even digit is extracted from the relative address "0000" and "1" is incremented thereto to obtain "0001", the screen moves from the area a to the area b. Similarly, each time "1" is incremented thereto, the image further moves to the areas c, d to the right side. When the screen is moved to the left side, the even digits may successively be decremented by "1" in the reverse operation thereto.

Also when the screen is moved in the vertical direction, the same method is employed. Referring to the left column, and when odd digits (first digit and third digit) are extracted from the relative addresses "0000", "0010", "1000" and "1010", binary expressions "00", "01", "10" and "11" are obtained. Accordingly, the screen shifts to the downward each time when an odd digit is incremented by one with a binary number. For example, the odd digit is extracted from the relative address "0000" and "1" is incremented thereto to obtain "0010", so that the screen moves from the area a to the area e. Similarly, each time "1" is incremented thereto, the image further moves to the areas f, g in the lower side. When the screen is moved upward, the odd digits may successively be decremented by "1" in the reverse operation thereto. This system is applicable not only to a case of dividing a screen into 16 units (4 bits) but also a case of dividing it into quarters, and to a case of dividing it into further higher order.

Figure 8:
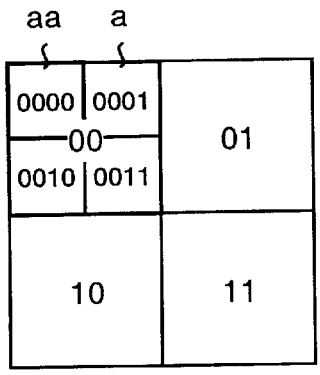
FIG. 8 is an explanatory view showing a case when a screen is enlarged or reduced by way of operating bits.

FIG. 8 is an explanatory view showing a case when a screen is enlarged or reduced by operating bits. This bit operation is executed by the format changing section 121. When the screen as an area aa with the relative address of "0000" is to be enlarged to a screen as an area a having a relative address of "00", the low order 2 bits in the relative address "0000" of the area aa are deleted, so that the relative address of "00" is obtained. Conversely, when the screen as an area a is to be reduced to the screen as an area aa, the relative address "00" is added to the end thereof. As described above, a screen can easily be enlarged or reduced by way of adding the low order 2 bits of the relative address thereto or deleting the 2 bits from the relative address.

Figure 9:
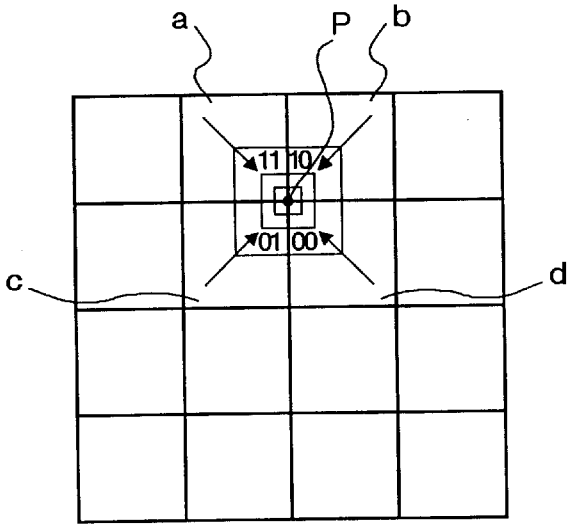
FIG. 9 is an explanatory view showing a case when a screen is enlarged or reduced around a specified point as a center thereof.
Figure 10A:
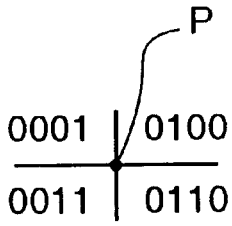
FIGS. 10A to 10C are explanatory views each showing a case when a screen is enlarged or reduced around a specified point as a center thereof.

FIG. 9 is an explanatory view showing a case when a screen is enlarged or reduced around a specified point as a center thereof. When the screen is reduced toward the point P as a center thereof, the relative addresses of the 16-divided areas a to d are "0001", "0100", "0011" and "0110" (FIG. 10A). When the reduction is made around this point P, and referring to the area a, the screen is reduced in the direction of the relative address "11". Namely, it is possible to specify a particular reduced area a successively by way of adding "11" to the end of the relative address "0001" of the area.

Figure 10B:
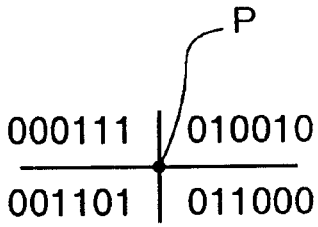
Figure 10C:
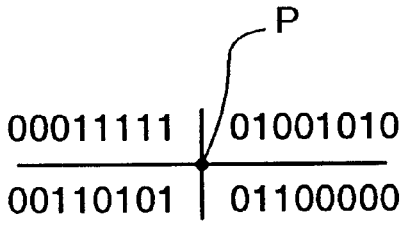

As shown in FIG. 10B and FIG. 10C, referring to the area b, the screen is reduced in the direction of the relative address "10", so that it is possible to specify successively any reduced area b by way of adding "10" to the end of the relative address "0100" of the area b. Referring to the area c, the screen is reduced in the direction of the relative address "01" so that it is possible to specify any reduced area c by way of successively adding "01" to the end of the relative address "0011" of the area c. Similarly, referring to the area d, the screen is reduced in the direction of the relative address "00" so that it is possible to specify any reduced area d by way of successively adding "00" to the end of the relative address "0110" of the area d.

Conversely, when a screen is to be enlarged, it is possible to enlarge the screen around the point p as a center thereof by way of successively deleting the low order 2 bits from a relative address. As described above, it is possible to easily enlarge or reduce an image around a given point P as a center by way of adding the low order 2 bits in the relative address thereto or deleting the lower two bits from the relative address.

As described above, the display device according to the present invention comprises a display unit for arranging display elements and constructing a screen by adding an absolute address to each of the display elements; and an address control unit for converting the absolute address to a relative address capable of specifying a screen on the display unit and changing the relative address, so that, when a screen is to be specified according to a relative address, it is possible to change a screen to be specified by changing this relative address. Through the steps described above, it is possible to easily change a position of a screen as well as a screen size without any change in the display data to be supplied only by changing the relative address.

The display device according to the present invention further comprises a display element storing unit for storing therein display data to be supplied to the display unit by unit of the display element; and a display data sending unit for sending the display data stored in this storing unit to each display element. With this configuration, in actual operations, the display data sending unit realized by a control unit or the like sends stored display data to each display element. Through the steps described above, a currently displayed image can be displayed again on a different screen in association with movement of the screen.

In the display device according to the present invention, an image is displayed by dividing a screen according to a specified format, repeating the division thereof one after another by further dividing each of the divided unit areas, specifying each of the divided unit areas with bits, and supplying display data to each divided unit area, so that it is possible to change a position or a size of the divided unit area by way of operating bits. Namely, as a divided unit area can be specified with bits, when these bits are operated, also the specified divided unit area can be changed. And for this reason, it is possible to easily change a position or a size of a screen by way of operating bits.

The display device according to the present invention further comprises a storing unit for storing therein the display data to be supplied; and a display data sending unit for sending the display data stored in this storing unit to a data bus. With the construction as described above, it is possible to display even an image already having been displayed on a screen after movement thereof by sending display data of the image having already been displayed from the storing unit.

In the display device according to the present invention, an image is displayed on a screen by arranging display elements at a matrix to form a screen, repeatedly dividing the screen, allocating an address to each divided unit area each time division is executed, specifying each of the divided unit areas according to each of the addresses, and supplying display data to the specified divided unit area. Then the image can be moved, enlarged, or reduced by changing the address. With the configuration as described above, it is possible to easily move a screen without any change in the display data only by way of changing the address.

In the display device according to the present invention, a control unit allocates a different address to each display data corresponding to each of a plurality of different images and makes the plurality of different images concurrently displayed at each of positions specified by those addresses. With the configuration as described above, it is possible to concurrently display a plurality of images on areas of a display screen only by operating the addresses.

In the display device according to the present invention, display elements are arranged at a matrix to form a screen, the screen is repeatedly divided into quarters, first addresses each consisting of 2 bits: "00", "01", and "11" are allocated to divided unit areas for each division thereof into quarters, a ¼ screen specified by the first address is further divided into quarters, second addresses each consisting of 2 bits: "00", "01", and "11" are allocated to the divided unit areas, and the division of the screen and allocation of addresses to each divided unit area are repeated arbitrary times thereafter. An image is displayed on the screen by specifying each of the divided unit areas according to each of the addresses and supplying display data to the specified divided unit. Then, in the construction described above, the image is enlarged or reduced by deleting or adding each 2-bit unit from or to the address. With the configuration as described above, it is possible to move a screen without changing any display data only by way of changing the address.

In the display device according to the present invention, an image is displayed on a screen by arranging display elements at a matrix to form a screen, repeatedly dividing the screen into quarters, allocating first addresses each consisting of 2 bits: "00", "01", and "11" to divided unit areas for each division thereof into quarters, further dividing a ¼ screen specified by the first address into quarters, allocating second addresses each consisting of 2 bits: "00", "01", "10", and "11" to the divided unit areas, repeating the division of the screen and allocation of addresses to each screen for arbitrary times thereafter and on, specifying each of the divided unit areas according to each of the addresses, and supplying display data to the specified divided unit area. Then the image is enlarged or reduced by deleting or adding bits closest to a given center point among the screen-specified addresses of "00", "01", "10" and "11" as divided unit areas obtained by dividing the screen specified by the corresponding address into quarters from/to the low order bits of the address. With the configuration as described above, a screen can be enlarged or reduced according to an arbitrary point as a reference.

In the display device according to the present invention, an image is displayed on a screen by arranging display elements at a matrix to form a screen, repeatedly dividing the screen into quarters, allocating first addresses each consisting of 2 bits: "00", "01", "10", and "11" to divided unit areas for each division thereof into quarters, further dividing a ¼ screen specified by the first address into quarters, allocating second addresses each consisting of 2 bits: "00", "01", "10", and "11" to the divided unit areas, repeating the division of the screen and allocation of addresses to each screen for arbitrary times thereafter and on, specifying each of the divided unit areas according to each of the addresses, and supplying display data to the specified divided unit area. Then, an even-digit and an odd-digit are extracted from a bit array of the address to be set to a binary format, and adding bits to the extracted number or subtracting the bits therefrom changes the address to move an image. With the configuration as described above, it is possible to easily move a screen by simple operations.

This application is based on Japanese patent application No. HEI 9-282852 filed in the Japanese Patent Office on Sep. 30, 1997, the entire contents of which are hereby incorporated by reference.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A display device comprising:

a display unit comprising a screen formed from the arrangement of a plurality of individual display elements into an array, each element comprising a controller and a memory, an absolute address being allocated to each of said display elements; and an address control unit operative to convert said-absolute address to a relative address capable of specifying a location on the screen of said display unit and to change said relative address for supplying the display data having said relative address to said display unit for displaying an image on a screen of said display unit, and said address control unit also being operative to change a position of said screen as well as a display size by changing said relative address.

2. A displaying device according to claim 1 further comprising:

a storing unit for storing therein said display data to be supplied; and a display data sending unit for sending said display data stored in this storing unit to a data bus.

3. A display device according to claim 1 further comprising:

a display element storing unit for storing therein display data to be supplied to said display unit in the unit of display element; and a display data sending unit for sending the display data stored in this storing unit to a display element.

4. A displaying device according to claim 3 further comprising:

a storing unit for storing therein said display data to be supplied; and a display data sending unit for sending said display data stored in this storing unit to a data bus.

5. A display device comprising:

a screen comprising a plurality of individual display elements arranged in an array and defining a screen area, each element comprising a controller and a memory;

a screen dividing unit for dividing said screen area into first unit areas according to a specified format and repeating said division thereof by further dividing each of the first unit areas into a plurality of second unit areas;

a display data supplying unit for specifying each of said divided unit areas according to a respective predetermined number of bits representing the displayed pixel and supplying display data to each said divided unit areas on said screen; and a bit operating unit for changing a position or a size of said divided unit areas by operating on said predetermined number of bits.

6. A displaying device according to claim 5 further comprising:

a storing unit for storing therein said display data to be supplied; and a display data sending unit for sending said display data stored in this storing unit to a data bus.

7. A display device comprising:

a display unit for arranging display elements in a matrix and forming a first screen; and a control unit for repeatedly dividing the first screen into unit areas, each unit area of said fist screen being made smaller by a subsequent division on said first screen; allocating an address comprising a predetermined number of bits to each divided unit area, said predetermined number being in inverse relation to the size of each division thereof; specifying each of said divided unit areas according to a respective one of said addresses; and moving the image, and enlarging or reducing the size thereof by changing said address when an image is to be displayed on said screen by supplying the display data to said specified divided unit area on said first screen.

8. A display device according to claim 7; wherein said control unit allocates a different address to each display data corresponding to each of a plurality of different images and concurrently displaying the plurality of different images at positions specified by those addresses respectively.

9. A display device comprising:

a display unit for arranging display elements at a matrix to form a screen; and a control unit for repeatedly dividing said screen into quarters; allocating first addresses each consisting of 2 bits: "00", "01", "10", and "11" to divided unit areas for each division thereof into quarters; further dividing a ¼ screen specified by the first address into quarters; allocating second addresses each consisting of 2 bits: "00", "01", "10", and "11" to the divided unit areas; repeating said division of the screen and allocation of addresses to each screen for arbitrary times thereafter and on; specifying each of said divided unit areas according to each of said addresses; and enlarging or reducing an image by deleting or adding each 2-bit unit from or to said address when the image is to be displayed on said screen by supplying the display data to said specified divided unit area.

10. A display device comprising:

a display unit for arranging display elements at a matrix to form a screen; and a control unit for repeatedly dividing the screen into quarters; allocating first addresses each consisting of 2 bits: "00", "01", "10", and "11" to divided unit areas for each division thereof into quarters; further dividing a ¼ screen specified by the first address into quarters; allocating second addresses each consisting of 2 bits: "00", "01", "10", and "11" to the divided unit areas; repeating said division of the screen and allocation of addresses to each screen for arbitrary times thereafter and on; specifying each of said divided unit areas according to each of said addresses; and enlarging or reducing an image by deleting or adding bits closest to a given center point among the screen-specified addresses of "00", "01", "10", and "11" as divided unit areas obtained by dividing the screen into quarters specified by said corresponding address from/to low order bits of said address when the image is to be displayed on said screen by supplying the display data to the specified divided unit area.

11. A display device comprising:

a display unit for arranging display elements at a matrix to form a screen; and a control unit for repeatedly dividing said screen into quarters; allocating first addresses each consisting of 2 bits: "00", "0", "10", and "11" to divided unit areas for each division thereof into quarters; further dividing a ¼ screen specified by the first address into quarters; allocating second addresses each consisting of 2 bits: "00", "01", "10", and "11" to the divided unit areas; repeating said division of the screen and allocation of addresses to each screen for arbitrary times thereafter and on; specifying each of said divided unit areas according to each of said addresses; extracting an even-digit as well as an odd-digit from a bit array of said address to be set to a binary format; and changing the address by adding bits to said extracted number or subtracting the bits therefrom to move an image when the image is to be displayed on said screen by supplying the display data to said specified divided unit area.

12. A display device as set forth in claim 1 wherein said controller is operative to select and fetch a signal corresponding to an absolute address.

13. A display device as set forth in claim 5 wherein said controller is operative to select and fetch a signal corresponding to an absolute address.

* * * * *